United States Patent [19]

Nauheimer

[11] 4,375,846

[45] Mar. 8, 1983

[54] CONTAINER

[75] Inventor: James F. Nauheimer, Chicago, Ill.

[73] Assignee: Container Corporation of America, Chicago, Ill.

[21] Appl. No.: 256,391

[22] Filed: Apr. 22, 1981

[51] Int. Cl.[3] ..... B65D 75/00

[52] U.S. Cl. ..... 206/195; 206/183; 229/28 BC; 229/52 BC

[58] Field of Search ..... 206/183, 187, 195, 140; 229/28 BC, 52 BC, 17 G

[56] References Cited

U.S. PATENT DOCUMENTS

| | | | |
|---|---|---|---|
| 2,362,995 | 11/1944 | Gilbert | 206/195 |
| 2,368,203 | 1/1945 | Crane | 206/140 |
| 2,527,025 | 10/1950 | Morgan | 206/195 |
| 3,044,211 | 7/1962 | Palm | 206/183 |
| 3,294,280 | 12/1966 | Graser | 206/140 |
| 3,348,671 | 10/1967 | Wood | 206/140 |
| 3,498,496 | 3/1970 | Edwards | 206/183 |
| 3,815,732 | 6/1974 | Klygis et al. | 206/183 |
| 4,253,564 | 3/1981 | Engdahl, Jr. | 206/183 |
| 4,328,893 | 5/1980 | Oliff et al. | 206/140 |

*Primary Examiner*—Joseph Man-Fu Moy

*Attorney, Agent, or Firm*—Richard W. Carpenter; Davis Chin

[57] ABSTRACT

A container formed from a cut and scored blank has end panels extending from sloping side panels and locked into position by cooperating slots formed in partition panels and the end panels.

5 Claims, 4 Drawing Figures

CONTAINER

BACKGROUND OF THE INVENTION

1. Field of the Invention

This invention relates generally to containers and more particularly, it relates to a carrier pack having end panels extending from sloping side panels and being interlocked with cooperating slots formed in partition panels and the end panels.

2. Description of the Prior Art

A prior art search directed to the subject matter of this application in the U.S. Patent and Trademark Office revealed the following U.S. Pat. Nos.: 2,134,627; 2,141,399; 2,215,907; 2,217,028; 2,300,492; 2,453,908; 2,527,025; 2,701,661; 3,208,659.

None of the prior art uncovered in the search disclosed a container like that of the present invention which provides end panels extending from sloping side panels and being interlocked with cooperating slots formed in partition panels and the end panels.

SUMMARY OF THE INVENTION

A container for a plurality of articles of commerce such as cans enables the cans to be displayed by causing the cans to extend partly through openings in sloping side panels of the container. The ends of the container are closed by generally trapezoidal shaped end panels foldably joined to the ends of the sloping side panels, these end panels being locked in position at slots formed at edges of locking flaps and by slots formed in central partition panels cooperating with the slots of the locking flaps.

DESCRIPTION OF THE PREFERRED EMBODIMENT

Figure 4:
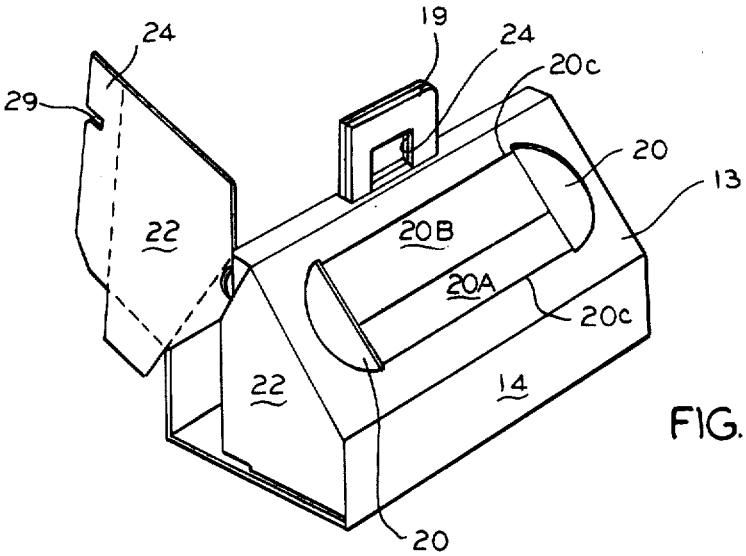
FIG. 4 is a similar isometric view showing a further step.
Figure 1:
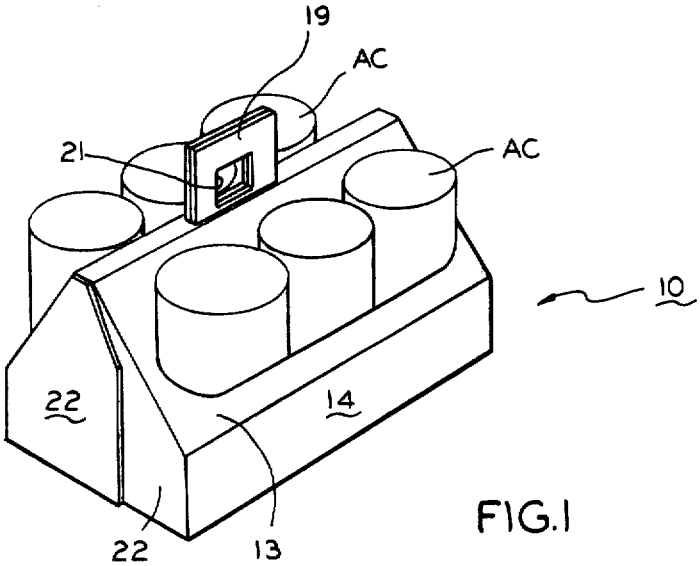
FIG. 1 is an isometric view of a container according to the present invention showing articles of commerce loaded therein.
Figure 2:
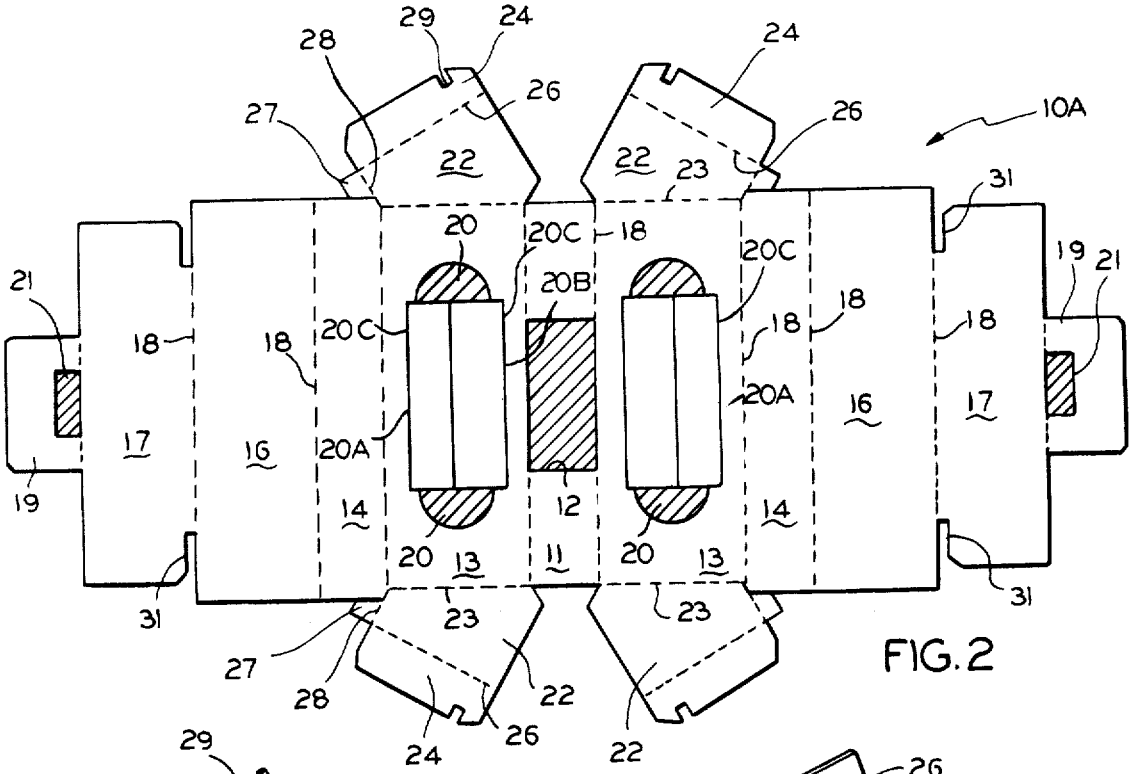
FIG. 2 is a plan view of a cut and scored blank for forming the container of FIG. 1.
Figure 3:
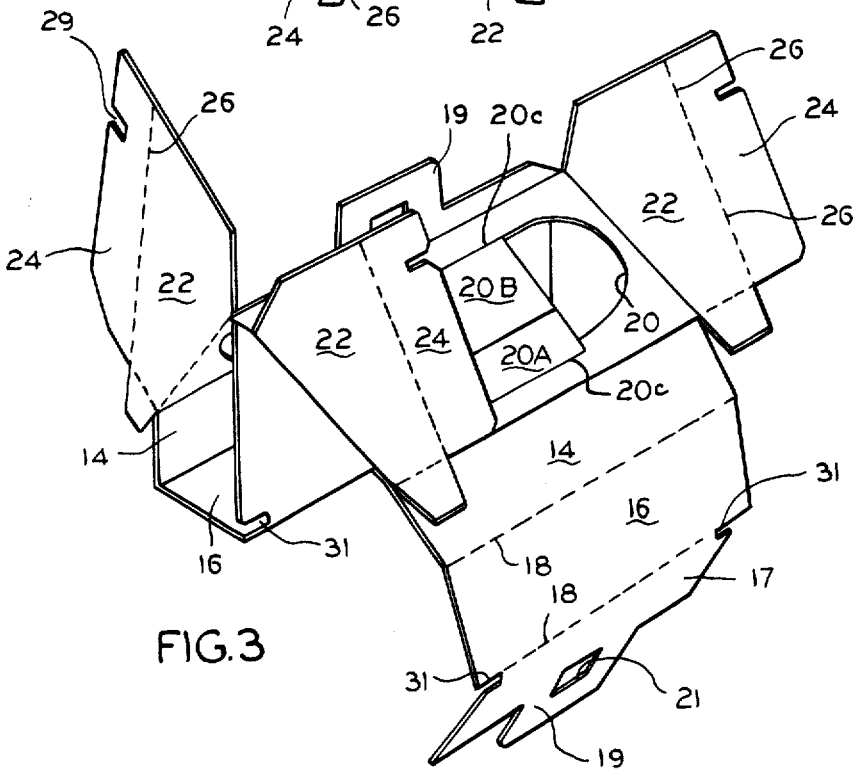
FIG. 3 is an isometric view showing a step in the formation of the container of FIG. 1.

As seen in FIG. 1 the container according to the invention is denoted by reference numberal 10 and is formed from a cut and scored blank 10A of paperboard or the like.

Blank 10A comprises a central top panel 11 having an opening 12 therein. Panel 11 is flanked to each side by a sloping side panel 13, front panel 14, bottom panel 16 and partition panel 17, these panels being joined serially by parallel fold lines 18.

Partition panel 17 has the distal end thereof provided with a handle 19 and handle opening 21. Each panel 13 has semi-circular spaced cut out areas 20 to each end of major and minor flaps 20B and 20A which are folded out of the plane of panel 13 upon insertion of articles AC into container 10.

If the articles AC are chimed, minor flap 20A is designed to engage the chimes and assist in holding articles AC in position in the opening in panel 13 occurring upon folding down of the flaps 20A and 20B along fold lines 20C. Flap 20B in its folded position lends stiffness to the top panel 11. It also reinforces structure on each side of cut out 12. This reinforcement is needed to keep structure from tearing when carried filled with product.

In the assembly of container 10 the partition panels 16 are erected and brought into facing relationship. Distal portions 19 thereof are brought through the opening 12 in panel 11, handle 19 protruding for carrying of the loaded container 10.

End closing panels 22 at each end of the sloping panels 13 are of generally trapezoidal shape, and are connected to sloping panels 22 along fold lines 23. End panels 22 are folded into partial overlapping relationship upon closing of the ends of container 10.

Structure is provided for locking the end panels 22 in position, such panels being in partial overlapping relationship upon assembly of container 10 as seen in FIG. 1.

To this end each end panel 22 has a flap 24 connected to panel 22 along a fold line 26. Each flap 24 is folded along the inside of bottom panel 16 and is provided with a locking slot 29 which cooperates with a locking slot 31 formed between bottom panel 16 and partition panel 17. Slot 31 is aligned with fold line 18 between panels 16 and 17.

Each of the end closing panels 22 is provided with a tab 27 connected thereto by fold line 28 and folded against the inside of front wall 14.

What is claimed is:

1. A container formed from a cut and scored blank of paperboard or the like comprising:

(a) a top panel flanked to each side by sloping side, front, bottom and partition panels connected along parallel score lines;

(b) said partition panels being folded into facing relationship;

(c) end closing panels of generally trapezoidal shape foldable with respect to said side panels into closing relationship;

(d) a slot in said partition panels at the ends thereof and adjacent the bottom panels connected thereto;

(e) a flap disposed at the distal portions of said end closing panels and folded into position atop its proximate bottom panel;

(f) said flap having a slot therein in cooperating relationship with the slot in a partition panel to hold said end closing panel in position; and (g) said sloping side panels having an aperture therein to receive articles of commerce, said aperture being formed of major and minor flaps foldable from the plane of said sloping side panels, said minor flaps being engageable with the chimes of said articles and said major flaps being foldable to a position for stiffening said top panel.

2. A container according to claim 1 wherein said top panel has an aperture therein through which said partition panels extend.

3. A container according to claim 2 wherein said partition panels are provided with handle elements at the upper extremities thereof.

4. A container according to claim 1 wherein said side panels slope from said top panel to said front panel and said closing panels are foldable with respect to said side panels.

5. A container according to claim 4 wherein said closing panels are foldable into partial overlapping relationship.

* * * * *